US006652122B2

(12) United States Patent
Lin

(10) Patent No.: US 6,652,122 B2
(45) Date of Patent: Nov. 25, 2003

(54) LOW-POWER HIGH-INTENSITY LIGHTING APPARATUS

(76) Inventor: Meng-Hsin Lin, No. 101, Ta-Hsing St., Tung Dist., Taichung City (TW)

( * ) Notice: Subject to any disclaimer, the term of this patent is extended or adjusted under 35 U.S.C. 154(b) by 0 days.

(21) Appl. No.: 10/196,399

(22) Filed: Jul. 16, 2002

(65) Prior Publication Data

US 2003/0016536 A1 Jan. 23, 2003

(30) Foreign Application Priority Data

Jul. 23, 2001 (TW) ..... 90212439 U

(51) Int. Cl.[7] ..... F21V 21/14

(52) U.S. Cl. ..... 362/250; 362/240; 362/247; 362/285; 362/519; 362/545; 362/310; 362/307

(58) Field of Search ..... 362/250, 240, 362/247, 285, 519, 545, 310, 307, 800, 245

(56) References Cited

U.S. PATENT DOCUMENTS 6,238,073 B1 * 5/2001 Ito et al. ..... 362/544

* cited by examiner

*Primary Examiner*—Stephen Husar
*Assistant Examiner*—Mark Tsidulko
(74) *Attorney, Agent, or Firm*—Trop, Pruner & Hu, P.C.

(57) ABSTRACT

A high-intensity lighting apparatus includes a housing, a lamp base mounted in the housing, and a lamp unit mounted on the lamp base. The lamp unit includes at least one light emitting diode and generates light that propagates rearwardly toward a curved reflector of the housing and that is reflected forwardly by the reflector.

17 Claims, 7 Drawing Sheets

LOW-POWER HIGH-INTENSITY LIGHTING APPARATUS

CROSS-REFERENCE TO RELATED APPLICATION

This application claims priority of Taiwanese application no. 090212439, filed on Jun. 23, 2001.

BACKGROUND OF THE INVENTION

1. Field of the Invention

The invention relates to a lighting apparatus, more particularly to a low-power high-intensity lighting apparatus that is easy to assemble and convenient to replace.

2. Description of the Related Art

A conventional high-intensity lighting apparatus, such as a warning indicating lamp, an emergency illumination equipment, an incandescent lamp, etc., usually relies on an incandescent bulb or fluorescent lamp as a light source, with an optional reflector for luminance enhancement. The aforesaid conventional high-intensity lighting apparatus is disadvantageous in that power consumption of the light source is relatively large.

Referring to FIGS. 1 and 2, to overcome the aforesaid drawback of large power consumption, another conventional lighting apparatus 1 is shown to include a housing 2, a pair of circuit boards 3 mounted on the housing 2, and a plurality of light emitting diodes 4 mounted on one of the circuit boards 3. The light emitting diodes 4 emit light directly and outwardly of the housing 2 without processing by a focusing element. Therefore, to achieve a certain degree of luminance, a large quantity of light emitting diodes 4 is needed, thereby resulting in a complicated circuit arrangement.

SUMMARY OF THE INVENTION

Therefore, the main object of the present invention is to provide a low-power high-intensity lighting apparatus that is easy to assemble and convenient to replace.

Another object of the present invention is to provide a low-power high-intensity lighting apparatus with a variable focusing effect.

Accordingly, a low-power high-intensity lighting apparatus of this invention comprises a housing, a lamp base mounted in the housing, and a lamp unit mounted on the lamp base. The lamp unit includes at least one light emitting diode and generates light that propagates rearwardly toward a curved reflector of the housing and that is reflected forwardly by the reflector.

Preferably, the lamp base is mounted adjustably on the reflector to achieve a variable focusing effect.

BRIEF DESCRIPTION OF THE DRAWINGS

Other features and advantages of the present invention will be come apparent in the following detailed description of the preferred embodiments with reference to the accompanying drawings, of which.

DETAILED DESCRIPTION OF THE PREFERRED EMBODIMENTS

Figure 1:
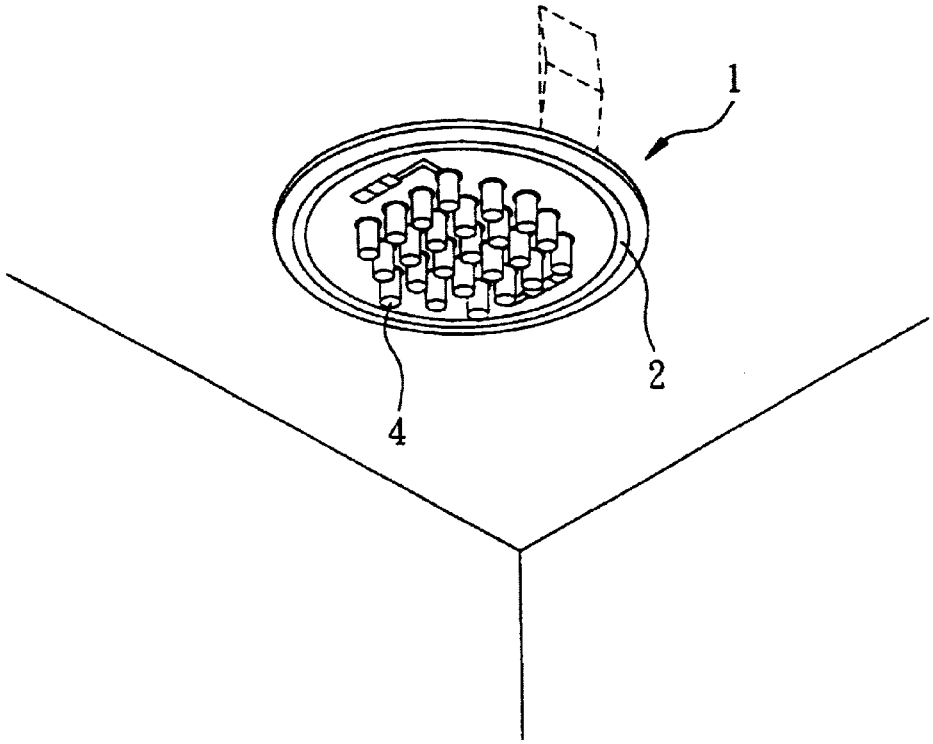
FIG. 1 PRIOR ART
FIG. 1 is a perspective view of a conventional lighting apparatus mounted on a ceiling.
Figure 2:
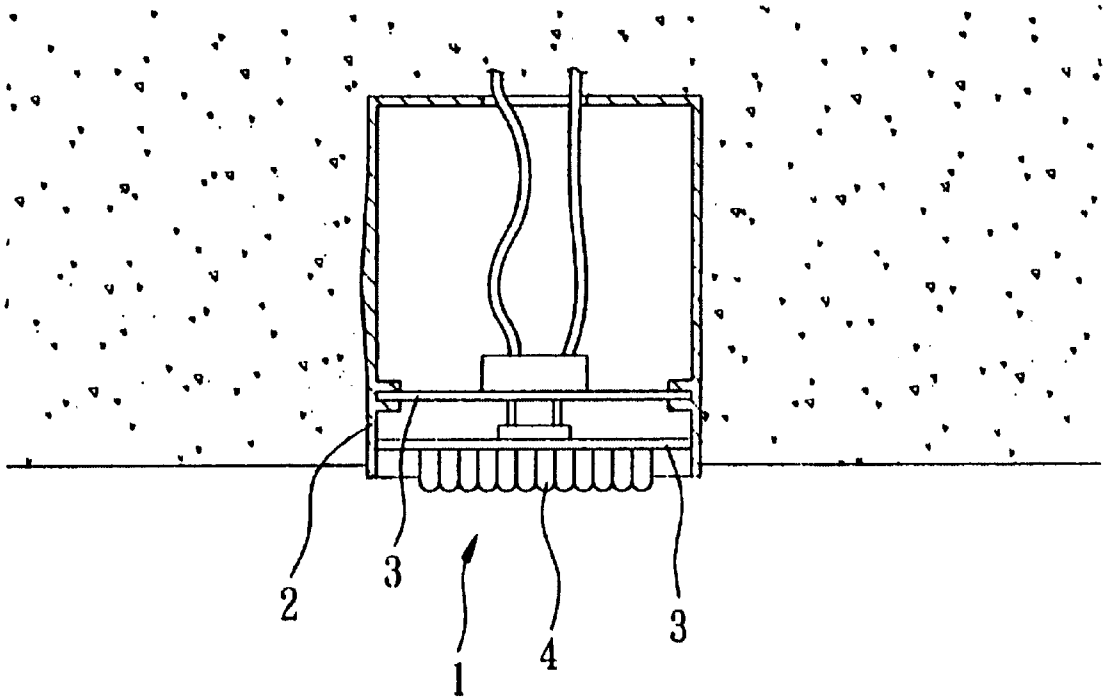
FIG. 2 PRIOR ART
FIG. 2 is a schematic sectional view of the conventional lighting apparatus of FIG. 1.
Figure 3:
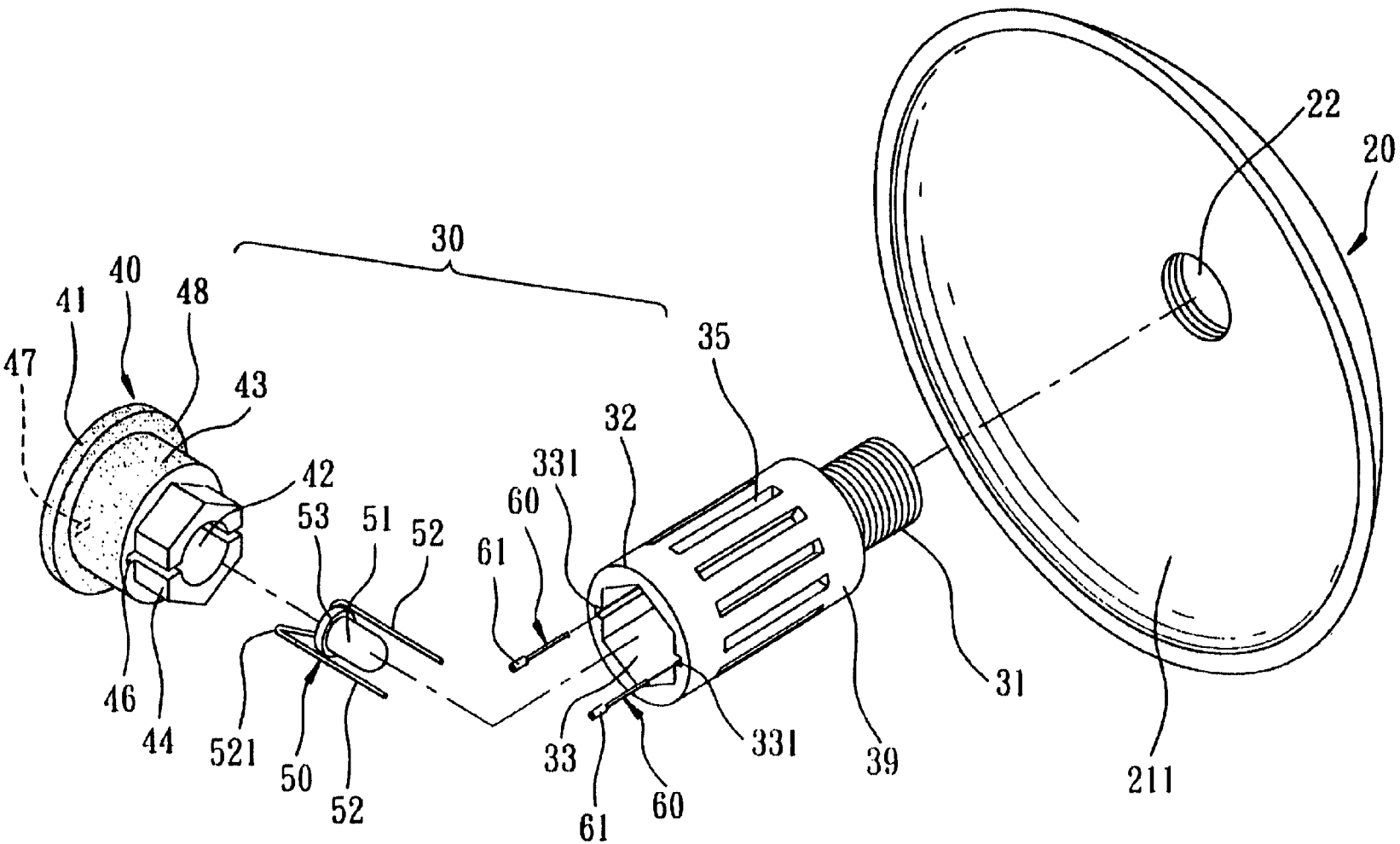
FIG. 3 is an exploded perspective view of a first preferred embodiment of a low-power high-intensity lighting apparatus according to the present invention.
Figure 4:
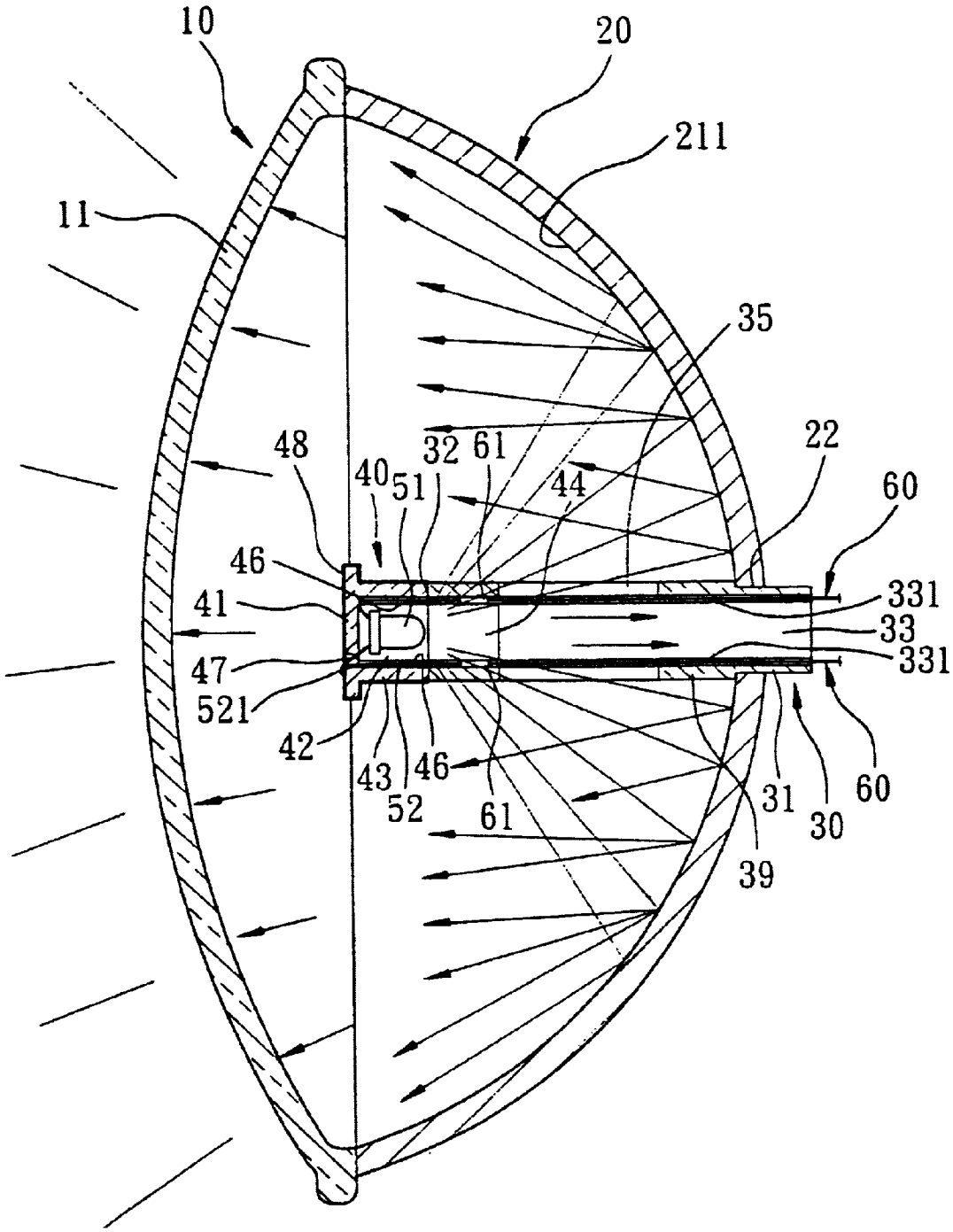
FIG. 4 is an assembled sectional view of the first preferred embodiment.

Referring to FIGS. 3 and 4, the first preferred embodiment of a low-power high-intensity lighting apparatus according to the present invention is shown to include a housing 10, a lamp base 30 and a lamp unit 50.

The housing 10 includes a curved reflector 20 with an open front end, and a light-transmissive cover 11 mounted on the reflector 20 at the open front end. The reflector 20 has a concave reflective surface 211. The concave reflective surface 211 has an intermediate part formed with an internally threaded mounting hole 22.

The lamp base 30 is mounted in the housing 10. In this embodiment, the lamp base 30 is mounted to the reflector 20 at the intermediate part of the concave reflective surface 211. The lamp base 30 includes a coupling post 39 and a cap 40. The coupling post 39 is tubular, is made of a light-transmissive material, and has an externally threaded end 31 that engages the reflector 20 in the mounting hole 22, and a cap engaging end 32 opposite to the threaded end 31. The coupling post 39 has an inner wall surface 33 formed with a pair of axially extending terminal grooves 331. Each of a pair of conductor units 60 extends from a power supply terminal (not shown), and has a socket end 61 disposed in a respective one of the terminal grooves 331 in the coupling post 39. The coupling post 39 is further formed with a plurality of axially extending slits 35 for light diffusing purposes.

The cap 40 is also made of a light-transmissive material, and includes a base wall portion 41, a surrounding wall portion 43 extending from the base wall portion 41, and a post engaging portion 44 extending from the surrounding wall portion 43. The base wall portion 41 is formed with a positioning hole 47. The surrounding wall portion 43 defines a diode-receiving cavity 42. The post engaging portion 44 is inserted into and engages the cap engaging end 32 of the coupling post 39. The surrounding wall portion 43 and the post engaging portion 44 of the cap 40 are formed with a pair of axially extending guide grooves 46 that are registered with the terminal grooves 331, respectively. In addition, the base wall portion 41 and the surrounding wall portion 43 have outer surfaces provided with a reflective coating 48.

The lamp unit 50 is mounted on the lamp base 30. In this embodiment, the lamp unit 50 includes a light emitting diode 53 that is disposed in the diode-receiving cavity 42, and generates light that propagates rearwardly toward the reflector 20 and that is reflected forwardly by the reflector 20. The light emitting diode 53 includes a diode body 51 and a pair of diode terminals 52 extending from the diode body 51. The diode terminals 52 are disposed respectively in the guide grooves 46 and extend respectively into the terminal grooves 331 to connect electrically and respectively with the socket ends 61 of the conductor units 60. One of the diode terminals 52 has a bent segment 521 that is extended through the positioning hole 47 and that is folded to lie against the base wall portion 41 outwardly of the cap 40 for securing the light emitting diode 53 to the cap 40.

In use, when power is supplied to the lamp unit 50, the light emitting diode 53 radiates light (as indicated by the arrows shown in FIG. 4) that not only passes through the coupling post 39, but also diffuses through the slits 35. The light propagates rearwardly toward the reflector 20 and is reflected forwardly by the same to pass through the light-transmissive cover 11 of the housing 10. A high luminance output is thus obtained. Furthermore, the reflective coating 48 on the base wall portion 41 and the surrounding wall portion 43 of the cap 40 also serves to enhance the luminance of the light output.

Figure 5:
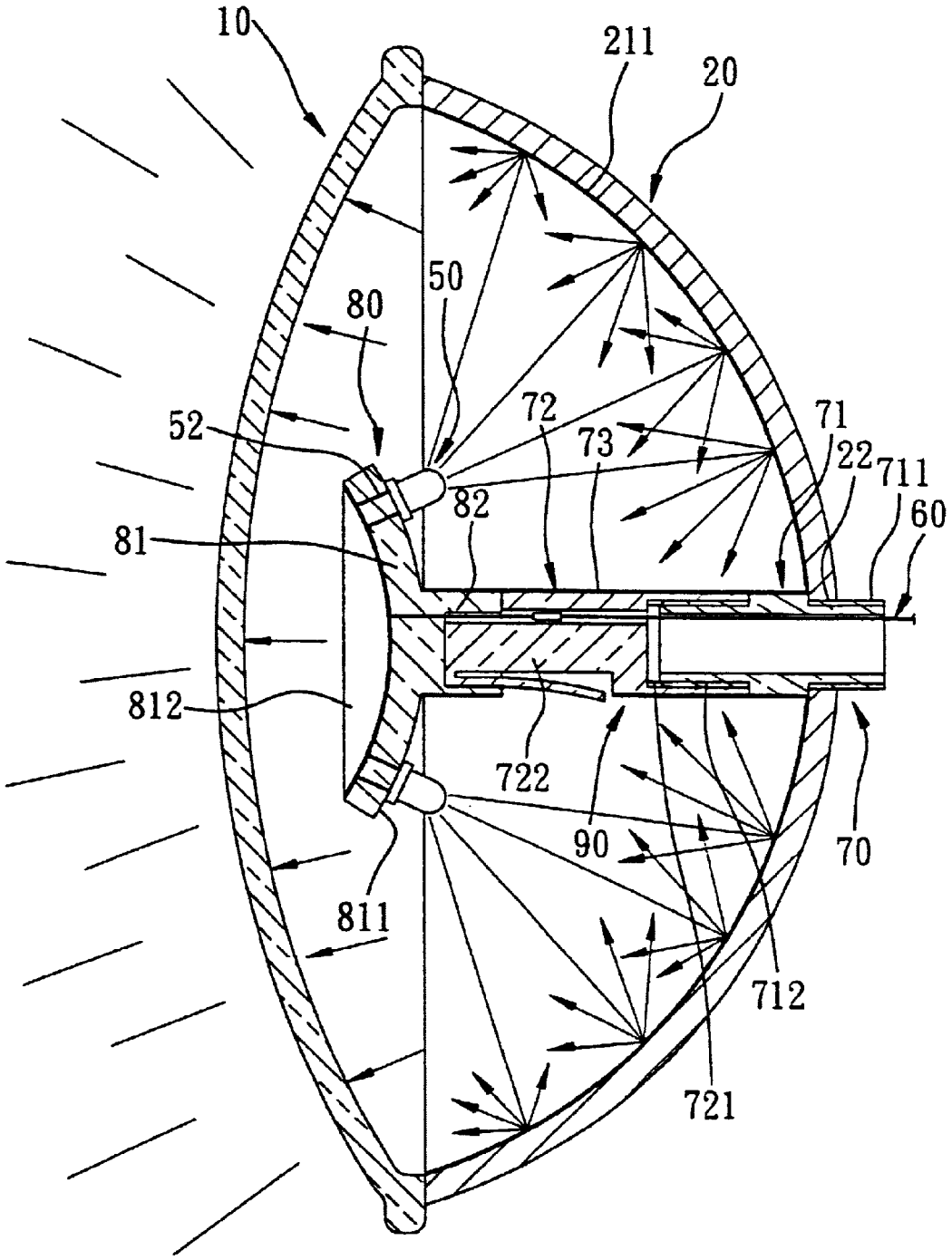
FIG. 5 is an assembled sectional view of a second preferred embodiment of a low-power high-intensity lighting apparatus according to the present invention.

Referring to FIG. 5, the second preferred embodiment of a low-power high-intensity lighting apparatus according to the present invention is shown to similarly include a housing 10, a lamp base 90 and a lamp unit 50.

Unlike the previous embodiment, the lamp base 90 includes a coupling post 70 and a lamp-mounting seat 80.

Figure 7:
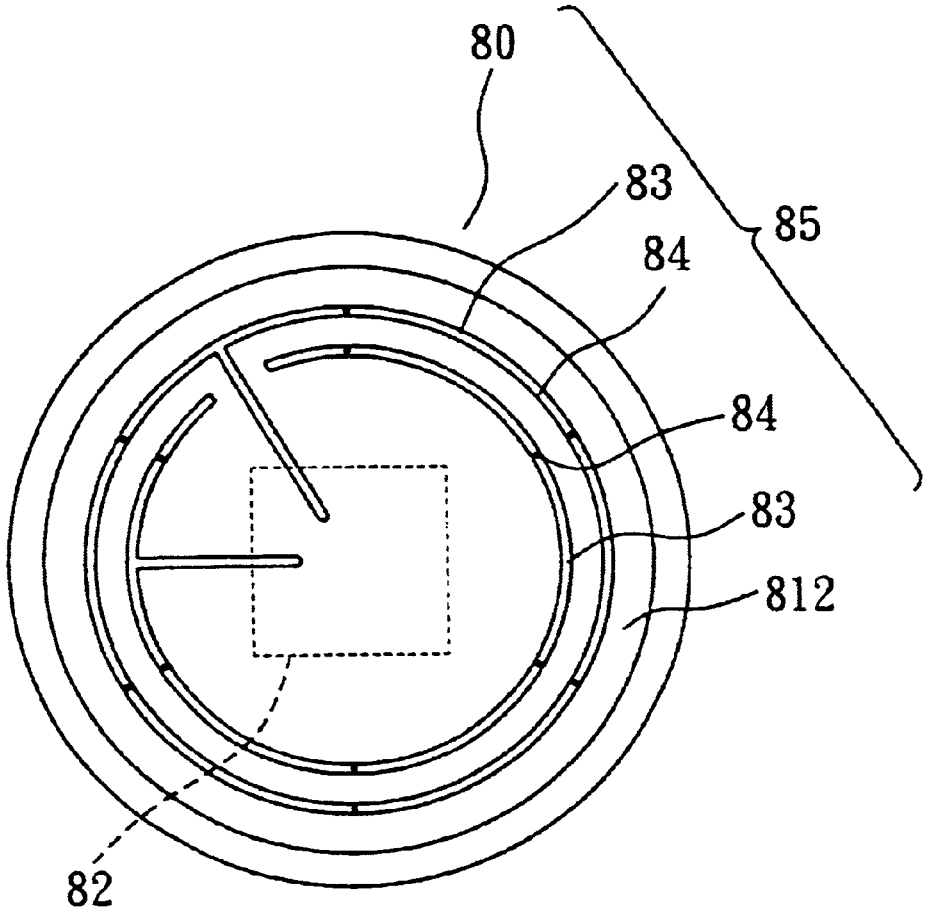
FIG. 7 is a schematic view of a printed circuit formed on a printed side of the lamp-mounting seat of the second preferred embodiment of the present invention.

The lamp-mounting seat 80 has a base wall portion 81 with a convex lamp-mounting side 811 that confronts the concave reflective surface 211 of the curved reflector 20 of the housing 10, and a coupling portion 82 extending from the lamp-mounting side 811 of the base wall portion 81. The base wall portion 81 further has a printed side 812 opposite to the lamp-mounting side 811 and formed with a printed circuit 85 (see FIG. 7). The printed circuit 85 includes a pair of concentric circuit traces 83. Each circuit trace 83 has a plurality of contact points 84 (six in this embodiment) angularly spaced apart from each other.

Figure 6:
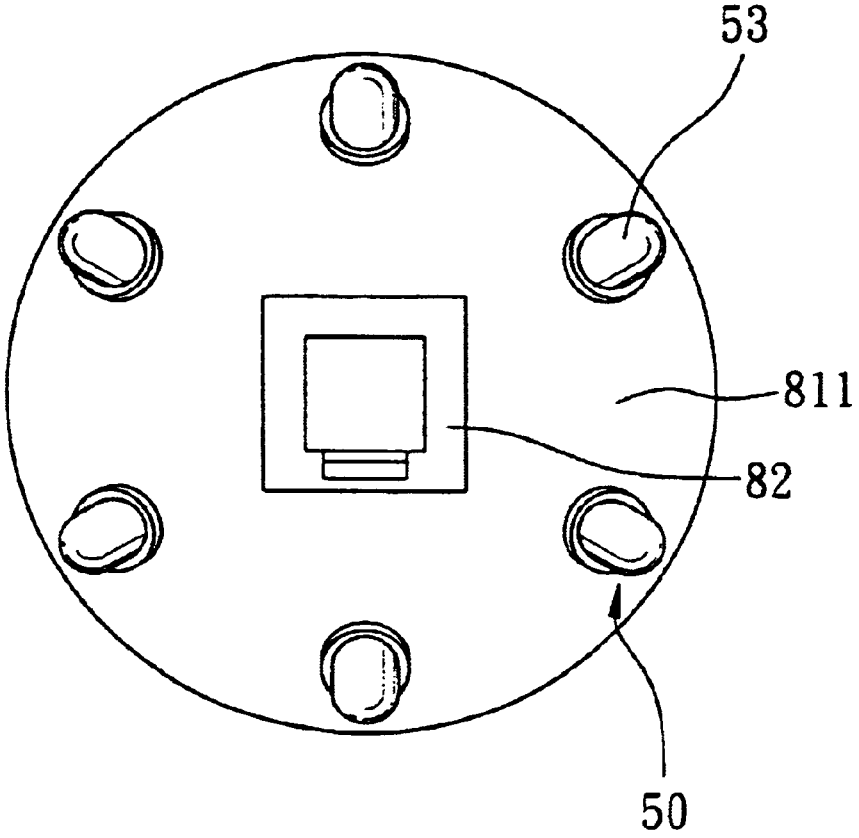
FIG. 6 is a schematic view illustrating a plurality of light emitting diodes mounted on a lamp-mounting side of a lamp-mounting seat of the second preferred embodiment of the present invention.

With further reference to FIG. 6, the lamp unit 50 includes a plurality of the light emitting diodes 53 (six in this embodiment) mounted on the lamp-mounting side 811 of the base wall portion 81. The light emitting diodes 53 are disposed around the coupling portion 82 of the lamp-mounting seat 80 and are angularly spaced apart from each other on the lamp-mounting side 811 of the base wall portion 81. Each of the light emitting diodes 53 has a pair of diode terminals 52, each of which is connected electrically to a respective one of the circuit traces 83 of the printed circuit 85 at a corresponding one of the contact points 84.

In this embodiment, the coupling post 70 includes a first post section 71 mounted to the reflector 20 at the intermediate part of the concave reflective surface 211, and a second post section 72 engaging the coupling portion 82 of the lamp-mounting seat 80. The first post section 71 has a first post end 711 that is threaded externally for engaging the reflector 20 in the mounting hole 22 at the intermediate part of the concave reflective surface 211, and an externally threaded post connecting end 712 opposite to the first post end 711. The second post section 72 is formed with an internally threaded post engaging end 721 for coupling threadedly with the post connecting end 712 of the first post section 71, and has a second post end 722 opposite to the post engaging end 721 for engaging the coupling portion 82 of the lamp-mounting seat 80. The second post end 722 and the coupling portion 82 engage each other in a known male-and-female type of engagement. The coupling post 70 has a pair of conductor units 60 adapted to connect electrically and respectively the circuit traces 83 of the printed circuit 85 on the lamp-mounting seat 80 to a power supply (not shown). Furthermore, the coupling post 70 has an outer surface provided with a reflective coating 73.

In use, when the lamp unit 50 radiates light (as indicated by the arrows shown in FIG. 5), the light propagates rearwardly toward the reflector 20 and is reflected forwardly by the same to pass through the light-transmissive cover 11 of the housing 10. The light that reaches the reflective coating 73 on the coupling post 70 is reflected back to the reflector 20. In this way, a high luminance output can be obtained.

Moreover, due to the threaded engagement between the coupling post 39, 70 and the reflector 20, and between the first and second post sections 71, 72 of the coupling post, a variable focusing effect can be achieved.

It has thus been shown that the low-power high-intensity lighting apparatus of this invention has a relatively simple construction that facilitates assembly and replacement and that permits focusing adjustment. The objects of the invention are thus met.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A low-power high-intensity lighting apparatus, comprising:

a housing including a curved reflector;

a lamp base mounted in said housing;

a lamp unit mounted on said lamp base, said lamp unit including at least one light emitting diode and generating light that propagates rearwardly toward said reflector and that is reflected forwardly by said reflector;

wherein said reflector has a concave reflective surface with an intermediate part, said lamp base being mounted to said reflector at said intermediate part of said concave reflective surface;

wherein said intermediate part of said concave reflective surface is formed with an internally threaded mounting hole, said lamp base including a coupling post having an externally threaded end that engages said reflector in said mounting hole;

wherein said lamp base further includes a cap having a base wall portion, a surrounding wall portion extending from said base wall portion, and a post engaging portion extending from said surrounding wall portion for engaging one end of said coupling post opposite to said externally threaded end.

2. The low-power high-intensity lighting apparatus as claimed in claim 1, wherein said reflector has an open front end, said housing further including a light-transmissive cover mounted on said reflector at said open front end.

3. The low-power high-intensity lighting apparatus as claimed in claim 1, wherein said light emitting diode is disposed in said cap.

4. The low-power high-intensity lighting apparatus as claimed in claim 3, wherein said coupling post is tubular and is made of a light-transmissive material.

5. The low-power high-intensity lighting apparatus as claimed in claim 4, wherein said coupling post is formed with a plurality of axially extending slits.

6. The low-power high-intensity lighting apparatus as claimed in claim 3, wherein said light emitting diode includes a diode body and a pair of diode terminals extending from said diode body, said coupling post having a pair of conductor units adapted to connect electrically and respectively said diode terminals to a power supply.

7. The low-power high-intensity lighting apparatus as claimed in claim 6, wherein said base wall portion of said cap is formed with a positioning hole, one of said diode terminals having a bent segment that is extended through said positioning hole and that is folded to lie against said base wall portion outwardly of said cap.

8. A low-power high-intensity lighting apparatus, comprising:

a housing including a curved reflector;

a lamp base mounted in said housing; and a lamp unit mounted on said lamp base, said lamp unit including at least one light emitting diode and generating light that propagates rearwardly toward said reflector and that is reflected forwardly by said reflector;

wherein said reflector has a concave reflective surface with an intermediate part, said lamp base being mounted to said reflector at said intermediate part of said concave reflective surface;

wherein said intermediate part of said concave reflective surface is formed with an internally threaded mounting hole, said lamp base including a coupling post having an externally threaded end that engages said reflector in said mounting hole;

wherein said base wall portion and said surrounding wall portion of said cap have outer surfaces provided with a reflective coating.

9. A low-power high-intensity lighting apparatus, comprising:

a housing including a curved reflector;

a lamp base mounted in said housing; and a lamp unit mounted on said lamp base, said lamp unit including at least one light emitting diode and generating light that propagates rearwardly toward said reflector and that is reflected forwardly by said reflector, wherein said lamp base includes a lamp-mounting seat having a base wall portion with a lamp-mounting side, and a coupling portion extending from said lamp-mounting side of said base wall portion and mounted to said reflector, said lamp unit including a plurality of said light emitting diodes mounted on said lamp-mounting side of said base wall portion;

wherein said lamp-mounting side is a convex side.

10. The low-power high-intensity lighting apparatus as claimed in claim 9, wherein said light emitting diodes are angularly spaced apart from each other on said lamp-mounting side.

11. The low-power high-intensity lighting apparatus as claimed in claim 9, wherein said reflector has a concave reflective surface with an intermediate part, said lamp base further including a coupling post having a first post end mounted to said reflector at said intermediate part of said concave reflective surface, and a second post end engaging said coupling portion of said lamp-mounting seat.

12. The low-power high-intensity lighting apparatus as claimed in claim 11, wherein said base wall portion further has a printed side opposite to said lamp-mounting side and formed with a printed circuit to connect electrically with said light emitting diodes.

13. The low-power high-intensity lighting apparatus as claimed in claim 12, wherein said coupling post has a pair of conductor units adapted to connect electrically said printed circuit to a power supply.

14. The low-power high-intensity lighting apparatus as claimed in claim 13, wherein said printed circuit includes concentric circuit traces, each of said conductor units being connected to a respective one of said circuit traces.

15. The low-power high-intensity lighting apparatus as claimed in claim 11, wherein said coupling post has an outer surface provided with a reflective coating.

16. The low-power high-intensity lighting apparatus as claimed in claim 11, wherein said intermediate part of said concave reflective surface is formed with an internally threaded mounting hole, said first post end being threaded externally for engaging said reflector in said mounting hole.

17. A low-power high-intensity lighting apparatus, comprising:

a housing including a curved reflector;

a lamp base mounted in said housing; and a lamp unit mounted on said lamp base, said lamp unit including at least one light emitting diode and generating light that propagates rearwardly toward said reflector and that is reflected forwardly by said reflector;

wherein said lamp base includes a lamp-mounting seat having a base wall portion with a lamp-mounting side, and a coupling portion extending from said lamp-mounting side of said base wall portion and mounted to said reflector, said lamp unit including a plurality of said light emitting diodes mounted on said lamp-mounting side of said base wall portion;

wherein said reflector has a concave reflective surface with an intermediate part, said lamp base further including a coupling post having a first post end mounted to said reflector at said intermediate part of said concave reflective surface, and a second post end engaging said coupling portion of said lamp-mounting seat;

wherein said coupling post includes a first post section formed with said first post end, and a second post section formed with said second post end, said second post section being coupled threadedly to said first post section.

* * * * *